US005579202A

United States Patent [19]

Tolfsen et al.

[11] Patent Number: 5,579,202

[45] Date of Patent: Nov. 26, 1996

[54] TRANSFORMER DEVICE

[75] Inventors: Ulf Tolfsen, Torsnes; Nils S. Syvertsen, Sølvstien; Johan Horsrud, Kjerrebuen, all of Norway

[73] Assignee: Labyrint Development A/S, Norway

[21] Appl. No.: 377,437

[22] Filed: Jan. 24, 1995

[30] Foreign Application Priority Data

Feb. 7, 1994 [NO] Norway ..... 940392

[51] Int. Cl.[6] ..... H01F 27/32

[52] U.S. Cl. ..... 361/232; 361/235; 336/181; 307/108

[58] Field of Search ..... 361/232, 235, 361/270, 264; 327/304; 336/84 C, 84 R, 180–182; 363/24, 134; 323/911; 307/108

[56] References Cited

U.S. PATENT DOCUMENTS

| | | | |
|---|---|---|---|
| 1,742,608 | 1/1930 | McDonough . | |
| 2,316,370 | 4/1943 | Smith et al. . | |
| 3,273,098 | 9/1966 | Saito . | |
| 3,638,155 | 1/1972 | Combs . | |
| 3,718,132 | 2/1973 | Holt et al. | 600/26 |
| 3,990,452 | 11/1976 | Murry et al. | 606/169 |
| 4,041,364 | 8/1977 | Gauper, Jr. | 363/15 |
| 4,233,658 | 11/1980 | Lupatin et al. | 363/26 |
| 4,429,694 | 2/1984 | McGreevy | 606/40 |
| 4,498,475 | 2/1985 | Schneiderman | 606/37 |
| 4,553,039 | 11/1985 | Stifter | 307/66 |
| 4,556,051 | 12/1985 | Maurer | 600/14 |
| 4,846,178 | 7/1989 | Fuxue et al. | 607/2 |
| 4,864,265 | 9/1989 | Peoples et al. | 336/5 |
| 5,055,993 | 10/1991 | Miyata et al. | 363/98 |
| 5,067,953 | 11/1991 | Feucht | 606/34 |
| 5,350,416 | 9/1994 | Guderian | 607/72 |

FOREIGN PATENT DOCUMENTS 2163911 3/1986 United Kingdom .

*Primary Examiner*—Fritz Fleming
*Attorney, Agent, or Firm*—Austin R. Miller

[57] ABSTRACT

An air-core transformer device for supplying a high-frequency, pulsating DC voltage on the secondary side of the transformer. The primary side of the transformer has two windings which are bifilar-wound having a mutual phase relationship of 180°, where the end of the first winding is connected in series with the beginning of the second winding at a common junction point. The voltage supply on the primary side is controlled by a time-set or time-variable power control signal at the beginning of the first winding and at the end of the second winding. A DC voltage is supplied to the common junction point. Two oscillatory circuits are formed on the primary side by a frequency control signal supplied over a field effect transistor, and are maintained by two capacitors C1 and C2, C1 being connected in parallel with the first winding and C2 being connected in parallel with the second primary winding. A first insulating layer is placed on the primary side, and around the first insulating layer there is provided an electrostatic screen which can be connected to an earth connection. A second insulating layer is positioned around the electrostatic screen. The secondary side of the transformer consists of a multi-layered secondary coil which is wound around the second insulating layer, each layer of the secondary coil being enveloped by an insulating material.

10 Claims, 4 Drawing Sheets

TRANSFORMER DEVICE

BACKGROUND OF THE INVENTION

1. Field of the Invention

The present invention relates to a device for supplying high-frequency, pulsating DC voltage on the secondary side of a transformer which does not have a core of ferromagnetic material, a so-called "air-core transformer", and where the primary side of the transformer has two windings which are bifilar-wound having a mutual phase relationship of 180°.

2. Description of the Prior Art

A device is previously known from within the field of radio engineering (medium wave) for a transformer/coil which operates in the 1 MHz frequency range. However, the known transformers/coils have small self-capacitance and high self-resonance in order to achieve the highest possible power output. Thus, they consist of two single-layered coils in series relation and are at an angle to one another in order to provide a specific tuning of the output stage in a transmitter to antenna loading. A transformer of this kind has a self-resonance that is too high to enable it to be used for the objective towards which the present invention is directed.

By way of further illustration of the prior art, mention can be made of U.S. Pat. No. 2,316,370 which relates to a pure parallel-wound coil having an iron core, and which is unsuited for high voltage or potential energy having a frequency of, e.g., 1 MHz.

SUMMARY OF THE INVENTION

The present invention can be used in an apparatus for administering physiotherapy to the human body, where the apparatus works according to the capacitor principle with the transfer of 1 MHz high-frequency alternating current to the patient, the injured area being subjected to an electrostatic field in accordance with the capacitor principle, and where the alternating current consists of a pulsating DC voltage.

In order to be able to provide a device of the kind mentioned by way of introduction and which is especially suited for the above-mentioned use, one of the objectives of the present invention has been that an air-core transformer of this kind must be capable of supplying a pulsating DC voltage having a frequency preferably in the region of 1 MHz and with a voltage value preferably in the range of 0–2600 V.

Furthermore, it is essential that the electromagnetism which normally occurs in all types of coils and transformers is a weak as possible, that there is minimal electromagnetic interference and eddy current, and moreover that the generation of heat in the transformer is low.

A further objective with the device, according to the present application, is that the transformer in the course of a short time must be capable of reaching optimum power output and working temperature at all the different power levels of output which can be set.

As a further objective of the invention, the intention is to keep the self-resonance of the transformer low, and moreover to have a transformer that is small in terms of physical size.

According to the invention, the present device is thus characterised in that the end of the first of the windings is coupled in series with the beginning of the second of the windings at a common junction point, the voltage supply on the primary side being effected by means of a time-set or time-variable power control signal at the beginning of the first winding and at the end of the second winding, and a DC voltage is supplied to said common junction point; that a capacitor is coupled on the primary side in parallel with the respective first and second primary windings to form two oscillatory circuits; that a first insulating layer is placed around the primary side; that around the first insulating layer there is provided an electrostatic screen which may be connected to an earth connection; that a second insulating layer is placed around said screen; that the secondary side of the transformer consists of a multi-layered secondary coil which is wound around the second insulating layer, each layer of the secondary coil being enveloped by an insulating material; and that the frequency of the pulsating DC voltage on the secondary side is twice the frequency of the power control signal.

According to additional embodiment of the device, the terminals of the secondary coil are adapted to be connected to treatment electrodes on a patient, a capacitor being connected in series between one of the terminals and one of the electrodes, which together with the patient's body lying between said electrodes, is included in a secondary side oscillatory circuit.

The winding layers of the secondary coil are preferably arranged as close, intercrossing-layers. The number of winding layers in the secondary coil is to advantage 8, with 36 turns in each layer.

In order to limit the generation of noise, noise suppressing ferrite cores are placed around a conductor leading from the first winding of the primary side and from the second winding, and an a noise suppressing ferrite core is also placed around a conductor leading from said common junction point.

The pulsating DC voltage on the secondary side has, according to the invention, a frequency in the range of 500 kHz–4 MHz, preferably in the region of approx. 1 MHz. Furthermore, it would be advantageous if the pulsating DC voltage on the secondary side were to have a value in the range of 0–2600 V.

The invention shall now be described in detail with reference to the attached drawings.

DETAILED DESCRIPTION OF THE INVENTION

Figure 1:
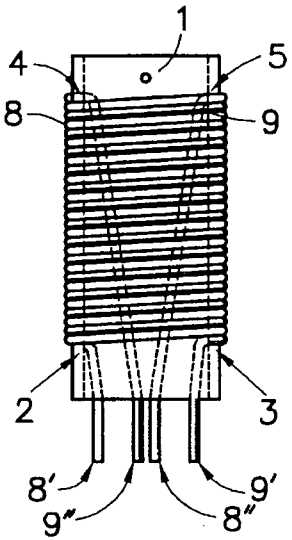
FIG. 1 shows a transformer, according to the present invention, with primary windings wound in place.
Figure 5:
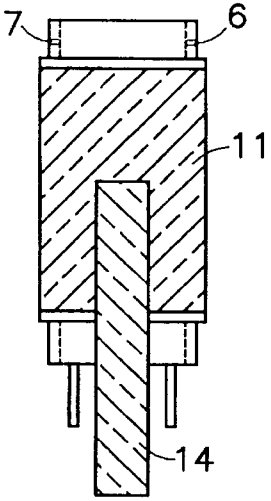
FIG. 5 shows the primary coil with the electrostatic screen as in FIG. 4, seen turned 90° and with the earth connection attached.
Figure 6:
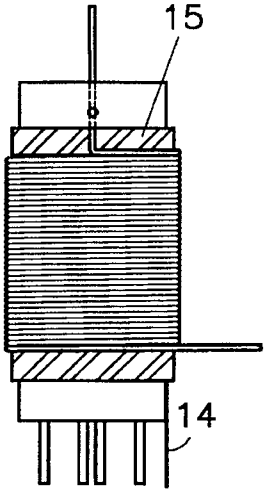
FIG. 6 shows the transformer in FIGS. 4 and 5 with the first layer of secondary winding applied.
Figure 7:
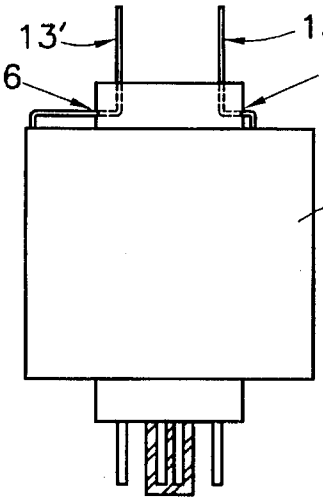
FIG. 7 shows the completely wound air-core transformer, according to the invention with an insulating tape placed over the last of the secondary winding layers.

The fully constructed transformer is illustrated in FIG. 7. Basically, the transformer is built up around a tube of electrically insulating material, e.g., PVC, such as the Sønel M-25 type. As shown in FIG. 1, tube 1 is cut away and provided with four holes 2, 3, 4 and 5 for the primary winding and two holes 6, 7 (FIGS 5. and 7) for the secondary winding.

Figure 8:
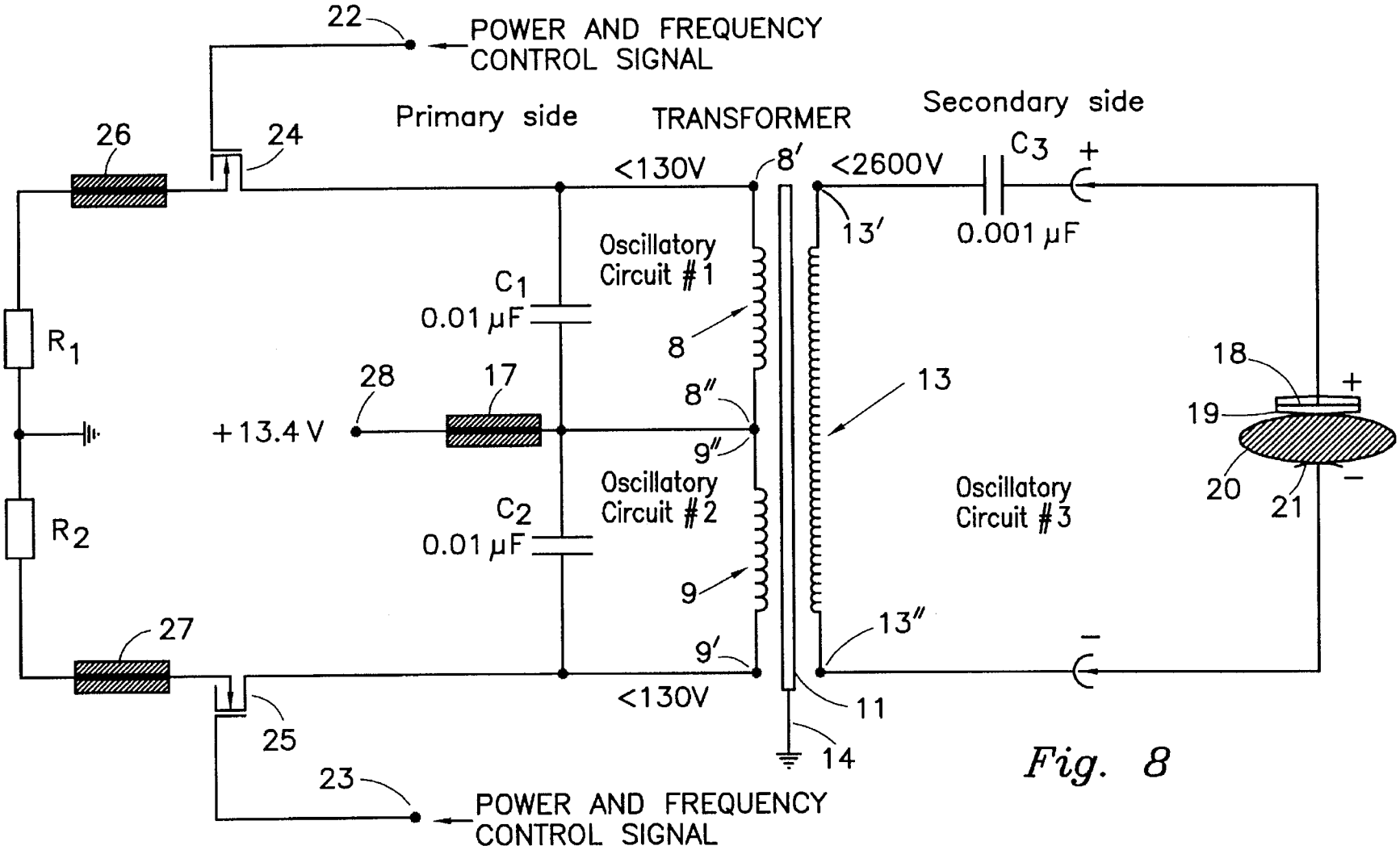
FIG. 8 shows a closed circuit which includes an air-core transformer according to the invention.

On the primary side there are two windings 8, 9. These are bifilar-wound having a reciprocal relationship of 180°. Each primary winding is wound such that it passes 11.5 times around the outside of the tube and in such a way that the two windings 8, 9, are as mentioned, displaced 180° relative to one another. As can be seen, the one primary winding 8 has an input end 8' and an output end 8", and the second primary winding 9 has an input end 9' and an output end 9". The output ends 8" and 9' of the primary windings are, as shown in FIG. 8, interconnected.

Figure 2:
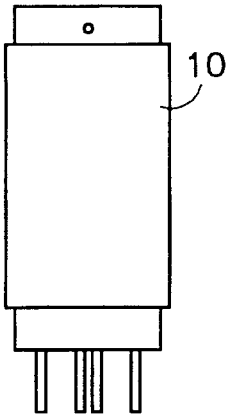
FIG. 2 shows the transformer in FIG. 1 with an insulating tape applied around the primary winding.

As is also made apparent in FIG. 1, both primary windings are inserted through the respective holes 2, 5 and 3, 4 into and out from the inside and underside of the tube 1. Subsequently, the insulating tape 10 is placed over the entire primary winding, as can be seen in FIG. 2.

Figure 3:
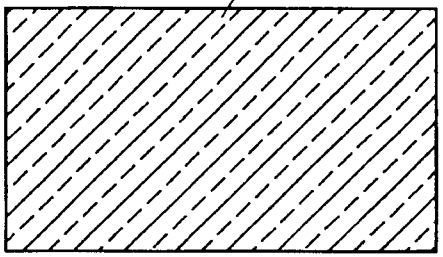
FIG. 3 shows an electrostatic screen for placing on the outside on the insulating tape in FIG. 2.
Figure 4:
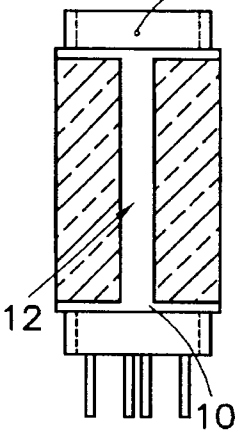
FIG. 4 shows the electrostatic screen placed around the primary winding.

A copper foil, for instance having a thickness of 0.1 mm, as indicated in FIG. 3 by means of the reference numeral 11, is placed over of the whole of the insulating tape 10, as is shown in FIG. 4, apart from a small opening 12, e.g., 3 mm in width, extending longitudinally at one of the holes, e.g., the hole 7 for the secondary winding 13.

A conductor 14 is then soldered into place, for instance a copper strip on said copper foil 11, the strip 14 being positioned 90° relative to the opening 12 in the foil 11. An electrically insulating layer 15, e.g., of the Melinex type, 45 mm in width, is then placed over the entire copper foil, with a 5 mm overlap. Insulating material will also be placed between each layer of the secondary winding. The insulating layer may, for instance, be of the Melinex type, but may of course also be a material that is sprayed on or applied in another manner.

If, for instance, a Melinex tape is used, it would be expedient to make a small notch in the insulating layer where the last winding of the layer ends so that the winding can be placed in the notch and then placed up onto the insulating layer as the next winding. In a practical embodiment, it would be expedient to have a total of 8 winding layers on the secondary side, with 36 turns per layer, so that the total number of turns on the secondary side would be 288. The two ends 13' and 13" of the secondary winding 13 are fed through respective holes 6 and 7 in the core or tube 1 and are fed out through the top of the tube 1.

After the last layer of the secondary winding has been laid, an additional insulating layer 16, e.g., an insulating tape, may be placed therearound.

The said copper foil 11 is used as an electrostatic screen to prevent disturbance or interference from being transferred capacitively. Any interferences will be conducted away via the earth connection 14. As is also shown in FIG. 8, in addition to the conductors 8" and 9' which are coupled together on the primary side, a ferrite core 17 is also provided to avoid the feedback of interference on the mains network.

One advantage with the transformer of the type described above is that it rapidly reaches the correct working temperature and is easy to cool. It is particularly important that a high-frequency circuit of the type illustrated in FIG. 8 does not affect or disturb other apparatus in the vicinity, or which are on the same circuit in a building. Electromagnetic noise and radiation must also be kept below a given level around the apparatus in question. Consequently, it will not be possible to use an iron core in the transformer, since the magnetic field in this case would be greatly increased, and in addition the noise level would rise to above critical values.

In the case of a transformer which does not have a core of ferromagnetic material, self-induction will be dependent upon the number of turns, the form and the dimension. The quality of the coil is determined by the relationship between self-induction and ohmic resistance in the copper wire of the coil. A transformer of this kind will always have a positive temperature coefficient. Since the secondary side constitutes a third oscillatory circuit with the capacitor C3, this capacitor should have a negative temperature coefficient and should withstand high frequency and high voltage. In that heat is compensated for in this way, a stable circuit is achieved. The capacitor C3 is positioned on the secondary side in series relation with a treatment electrode 18. The treatment electrode 18 is provided with a dielectric 19. A patient, schematically indicated by means of the reference numeral 20, is placed between the positive electrode 18 and a negative electrode 21 connected to a negative outlet 13" on the secondary side.

The value of the capacitor C3 may typically be 0.001 microfarad.

In the case of the oscillatory circuits nos. 1 and 2, capacitors C1 and C2 are positioned parallel to respective primary windings 8 and 9, each capacitor preferably having a value equal to 0.01 microfarad. These capacitors are of a type that withstands high frequency and high voltage.

On the secondary side of the transformer, the tightly crossing layers together with the self-capacitance of the coil will generate resonance frequency. This self-resonance should be as low as possible, and this is the reason for the windings on the secondary side being laid in tightly crossing layers. This gives least possible electromagnetic noise and least loss on the secondary side. By virtue of the fact that the transformer operates above its own resonance frequency, the secondary side of the transformer will, in circuit terms, also operate as a capacitor. For this reason the outermost winding 13' on the secondary side is marked with a plus sign (+) and the innermost winding 13" on the secondary side is marked with a minus sign (–).

The positive side is thus connected to said electrode 18 and the negative side is connected to the electrode 21, whereby an electrostatic field arises between these two electrodes.

As the operating frequency for the transformer 1 MHz has been chosen, based on medical grounds, this frequency being considered harmless to living tissue (cells). Thus, the permanent output frequency from the transformer is preferably 1 MHz, although the level of energy will be variable.

Theoretically, it is however possible to use a transformer which operates at a somewhat lower frequency, e.g., as low as 750 kHz or at a higher frequency, e.g., as high as 4 MHz.

Figure 9:
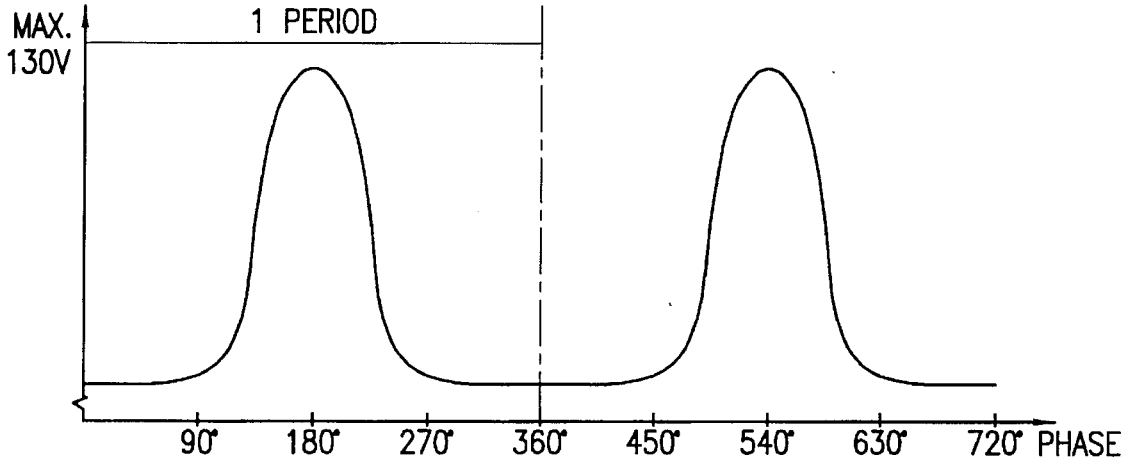
FIG. 9 shows the oscillation signal for the first oscillatory circuit on the primary side.
Figure 10:
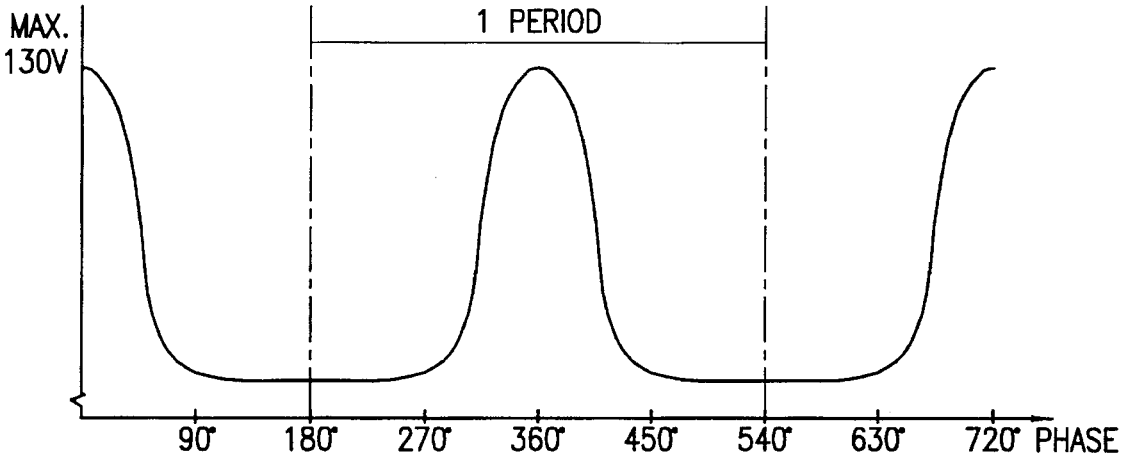
FIG. 10 shows the oscillation signal for the second oscillatory circuit on the primary side.

In FIGS. 9 and 10 the reciprocal phase relationship between the oscillations in oscillatory circuit no. 1 and oscillatory circuit no. 2 is shown. As can be seen, the oscillations in oscillatory circuit no. 2 (FIG. 10) are 180° out of phase with the oscillations in oscillatory circuit no. 1. Both oscillatory circuits are supplied with the same control signal via respective control signal inputs 22 and 23 via respective field effect transistors 24 and 25. To attentuate noise pulses, ferrite cores 26 and 27 may be placed around respective connections to earth via respective resistors R1 and R2.

Figure 11:
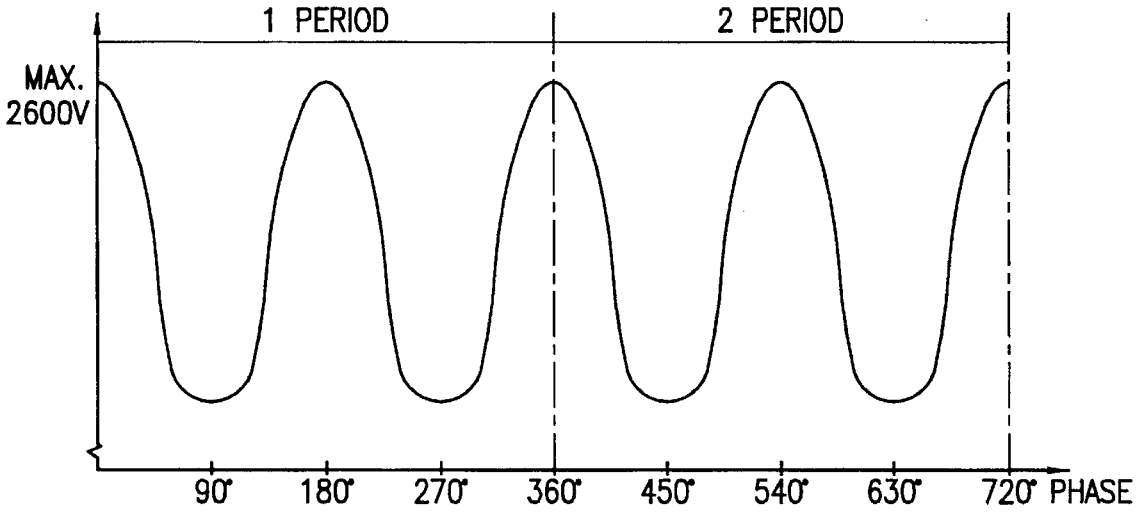
FIG. 11 shows the signal of the oscillatory circuit on the secondary side, circuit no. 3.

As can be seen from FIG. 11, in the oscillatory circuit no. 3 on the secondary side an alternating DC voltage potential will be generated where the frequency is twice the frequency in each of the oscillatory circuits no. 1 and no. 2. The maximum amplitude in oscillatory circuits nos. 1 and 2 will be 130 V in a preferred embodiment of the device, whereas the voltage output on the secondary side of the transformer will vary between 0 and a maximum of 2600 V.

Figure 12:
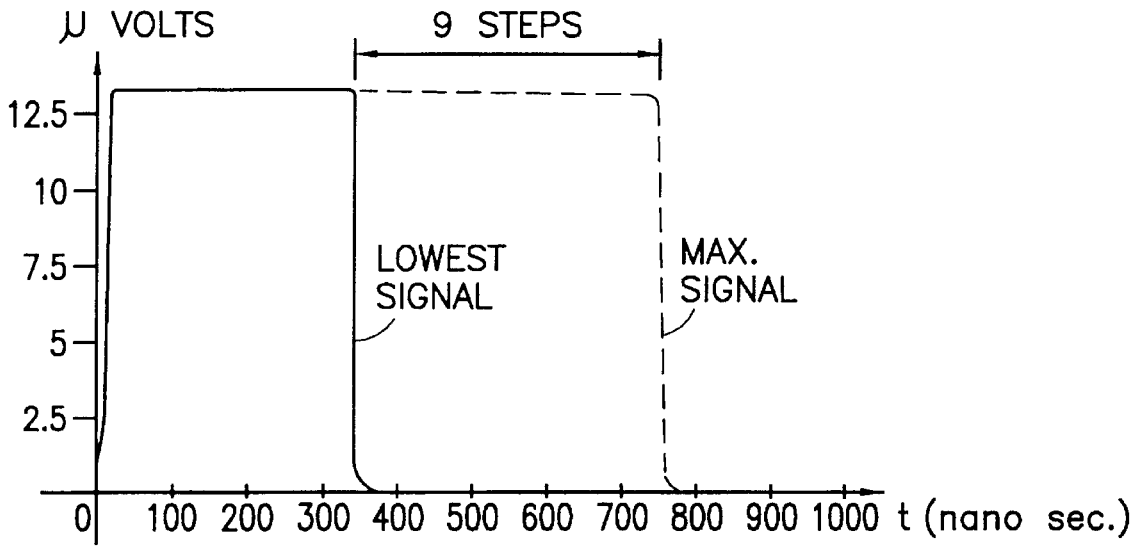
FIG. 12 shows a typical power control signal for the two oscillatory circuits on the primary side.

To control the power level, a permanent DC voltage having a maximum amplitude of 13.4 V is placed on a terminal 28 which leads to the common point between the two oscillatory circuits on the primary side, inter alia, in the common junction between the ends of the windings 8" and 9', and a power control signal which is fed into terminals 22 and 23. In a preferred embodiment, the power control signal can be varied from a minimum value to a maximum value by varying its duration, e.g., from 350 nanoseconds as shown in FIG. 12; to 750 nanoseconds. The variation can take place in steps, e.g., in 9 or 10 steps as shown in FIG. 12 or, alternatively, it may be stepless.

Figure 13:
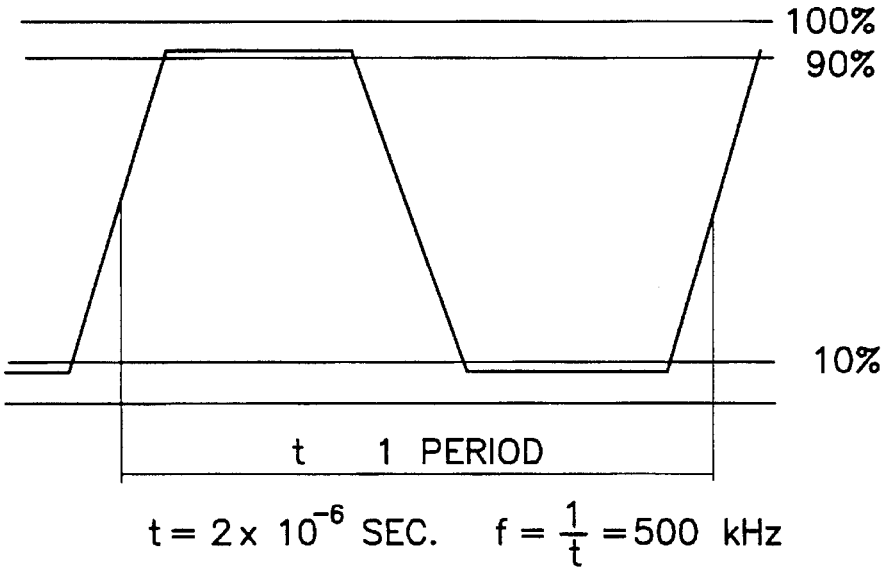
FIG. 13 shows a frequency control signal for the two oscillatory circuits on the primary side.

The frequency control signal which is fed into the terminals 22 and 23, as shown in FIG. 13, is approximately trapezoid, the frequency being 500 kHz. Because of the bifilar-wound primary side of the transformer, there will be, as described in connection with FIGS. 9–11, a frequency doubling on the secondary side of the transformer. When the patient 20 is connected to the oscillatory circuit no. 3 on the secondary side, a capacitor oscillatory circuit will be created on the use of the treatment electrodes 18 and 21, where the secondary side of the transformer gives a pulsating DC voltage having a maximum value of 2600 V and a frequency of 1 MHz.

When using higher voltages for the transformer, there will be other requirements with regard to both the construction of the transformer and the choice of materials. This is due to the fact that in this case there will be an increased generation of heat in the transformer and corresponding stress on the insulating material which has been applied to the windings and the insulating layers and the insulating tapes. Moreover, one must expect the noise level to increase considerably.

An advantage with the present device is that the transformer's conductors on the primary side have little magnetic effect as long as the current passes in separate directions in each of the two windings 8 and 9, whilst on the other hand the effect will be intensified when the current flows in the same direction in the two windings.

By virtue of the present invention, a transformer device of the type mentioned by way of introduction is thus provided, which gives rise to particularly great advantages in connection with a pattient treatment apparatus, although other uses would be obvious to an expert in the art, optionally on the basis of minor modifications of the circuit that is shown in FIG. 8.

Having described our invention, we claim:

1. A transformer device, said transformer device having a primary side and a secondary side and being capable of supplying a high-frequency, pulsating DC voltage on said secondary side, said transformer device being an air core type having no core of ferromagnetic material, said transformer device comprising:

a first winding and a second winding, said windings being bifilar-wound in a reciprocal phase relationship of 180°, said first winding and said second winding each having a beginning portion and an end portion, a coupling of said first and second windings, said coupling being in series and including a common junction point of said end portion of said first winding and said beginning portion of said second winding, a voltage supply on said primary side, said voltage supply being controlled by a time-set or time-variable power control signal at said beginning portion of said first winding and at said end portion of said second winding, said voltage supply providing a DC voltage to said common junction point;

two capacitors positioned on said primary side, one of said capacitors being coupled in parallel to said first winding and the other of said capacitors being coupled in parallel to said second winding so as to form two oscillatory circuits;

a first insulating layer positioned around said primary side;

an electrostatic screen positioned around said first insulating layer, said electrostatic screen being capable of being connected to a ground connection;

a second insulating layer positioned around said electrostatic screen;

a multi-layered secondary coil on said secondary side, said secondary coil comprising layers wound around said second insulating layer, each wound layer of said secondary coil being enveloped by an insulating material; and wherein said pulsating DC voltage on said secondary side has a frequency which is twice the frequency of said power control signal.

2. A transformer device as disclosed in claim 1, wherein said secondary coil has terminals connected to treatment electrodes capable of being used on a patient, said transformer device further comprising a capacitor connected in series between one of said terminals and one of said electrodes, which, together with said patient positioned between said electrodes, forms a secondary side oscillating circuit.

3. A transformer device as disclosed in claim 2, wherein said wound layers of said secondary coil are arranged as adjacent, intercrossing layers.

4. A transformer device as disclosed in claim 3, wherein said secondary coil comprises eight of said wound layers, and each of said wound layers comprises 36 turns.

5. A transformer device as disclosed in claim 1, wherein said wound layers of said secondary coil are arranged as adjacent, intercrossing layers.

6. A transformer device as disclosed in claim 5, wherein said secondary coil comprises eight of said wound layers, and each of said wound layers comprises 36 turns.

7. A transformer device as disclosed in claim 1, further comprising noise suppressing ferrite cores, a first conductor leading from said first winding on said primary side, a second conductor leading from said second winding on said primary side, and a third conductor leading from said common junction point, each of said conductors extending through at least one of said noise suppressing ferrite cores.

8. A transformer device as disclosed in claim 1, wherein said frequency of said pulsating DC voltage on said secondary side is in the range of 500 kHz–4 MHz.

9. A transformer device as disclosed in claim 1, wherein said pulsating DC voltage on said secondary side is in the range of 0–2600 V.

10. A transformer device as disclosed in claim 1, wherein said frequency of said pulsating DC voltage on said secondary side is approximately 1 MHz.

* * * * *